US008813613B2

(12) United States Patent
Chen

(10) Patent No.: US 8,813,613 B2
(45) Date of Patent: Aug. 26, 2014

(54) SCREWDRIVER WITH CHANGEABLE HEAD UNITS

(75) Inventor: Yan-Yu Chen, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 288 days.

(21) Appl. No.: 13/278,118

(22) Filed: Oct. 20, 2011

(65) Prior Publication Data

US 2013/0047796 A1 Feb. 28, 2013

(30) Foreign Application Priority Data

Aug. 30, 2011 (TW) ..... 100130989 A

(51) Int. Cl.
*B25G 1/08* (2006.01)

(52) U.S. Cl.
USPC ..... 81/438; 81/177.4; 81/490

(58) Field of Classification Search
USPC ..... 81/438, 177.4, 490
See application file for complete search history.

(56) References Cited

U.S. PATENT DOCUMENTS

| | | | | |
|---|---|---|---|---|
| 6,032,332 | A * | 3/2000 | Lin | 81/177.4 |
| 6,742,421 | B1 * | 6/2004 | Chen | 81/490 |
| 7,174,814 | B2 * | 2/2007 | Liao | 81/177.4 |
| 7,565,852 | B2 * | 7/2009 | Yu | 81/177.4 |
| D657,214 | S * | 4/2012 | Chen | D8/25 |

* cited by examiner

*Primary Examiner* — Hadi Shakeri
(74) *Attorney, Agent, or Firm* — Novak Druce Connolly Bove + Quigg LLP

(57) ABSTRACT

An exemplary screwdriver includes a handle unit, head units for operating different kinds of fasteners, a head reception unit fixed on the handle unit and receiving the head units therein, and a pole unit fixed on the handle unit. Each of the head units is removably attachable on the pole unit so that the screwdriver can operate the different kinds of fasteners as required.

2 Claims, 3 Drawing Sheets

SCREWDRIVER WITH CHANGEABLE HEAD UNITS

BACKGROUND

1. Technical Field

The present disclosure relates to screwdrivers, and particularly to a screwdriver with changeable head units.

2. Description of Related Art

When screws in different sizes and shapes are screwed or unscrewed, different kinds of screwdrivers are required. However, it may be difficult for a person to carry around a number of screwdrivers needed for different kinds of screws. Screwdrivers with changeable head units are often used to decrease the work of carrying around a number of screwdrivers for different kinds of screws. In use of a screwdriver with changeable head units, different kinds of head units corresponding to different kinds of screws can be respectively attached to the shank of the screwdriver. However, when one of the head units is attached on the screwdriver, the other head units are separate from the screwdriver. It may be awkward or difficult to carry around the loose head units, and they are liable to become lost.

Therefore, there is room for improvement within the art.

BRIEF DESCRIPTION OF THE DRAWINGS

Many aspects of the present disclosure can be better understood with reference to the following drawings. The components in the various drawings are not necessarily drawn to scale, the emphasis instead being placed upon clearly illustrating the principles of the present disclosure. Moreover, like reference numerals designate corresponding parts throughout the drawings.

DETAILED DESCRIPTION

Figure 1:
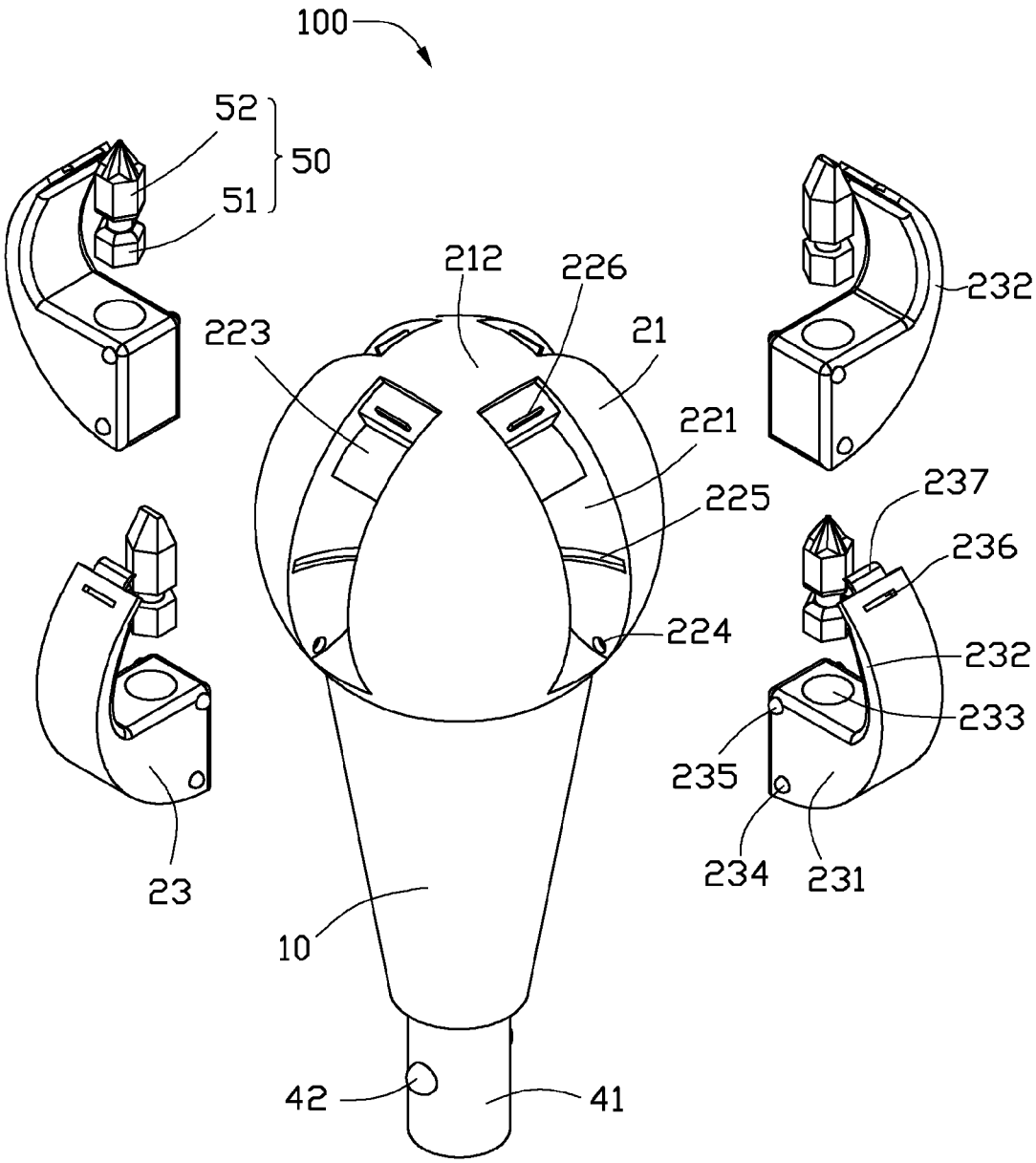
FIG. 1 is a schematic, disassembled view of a screwdriver, according to an exemplary embodiment.
Figure 2:
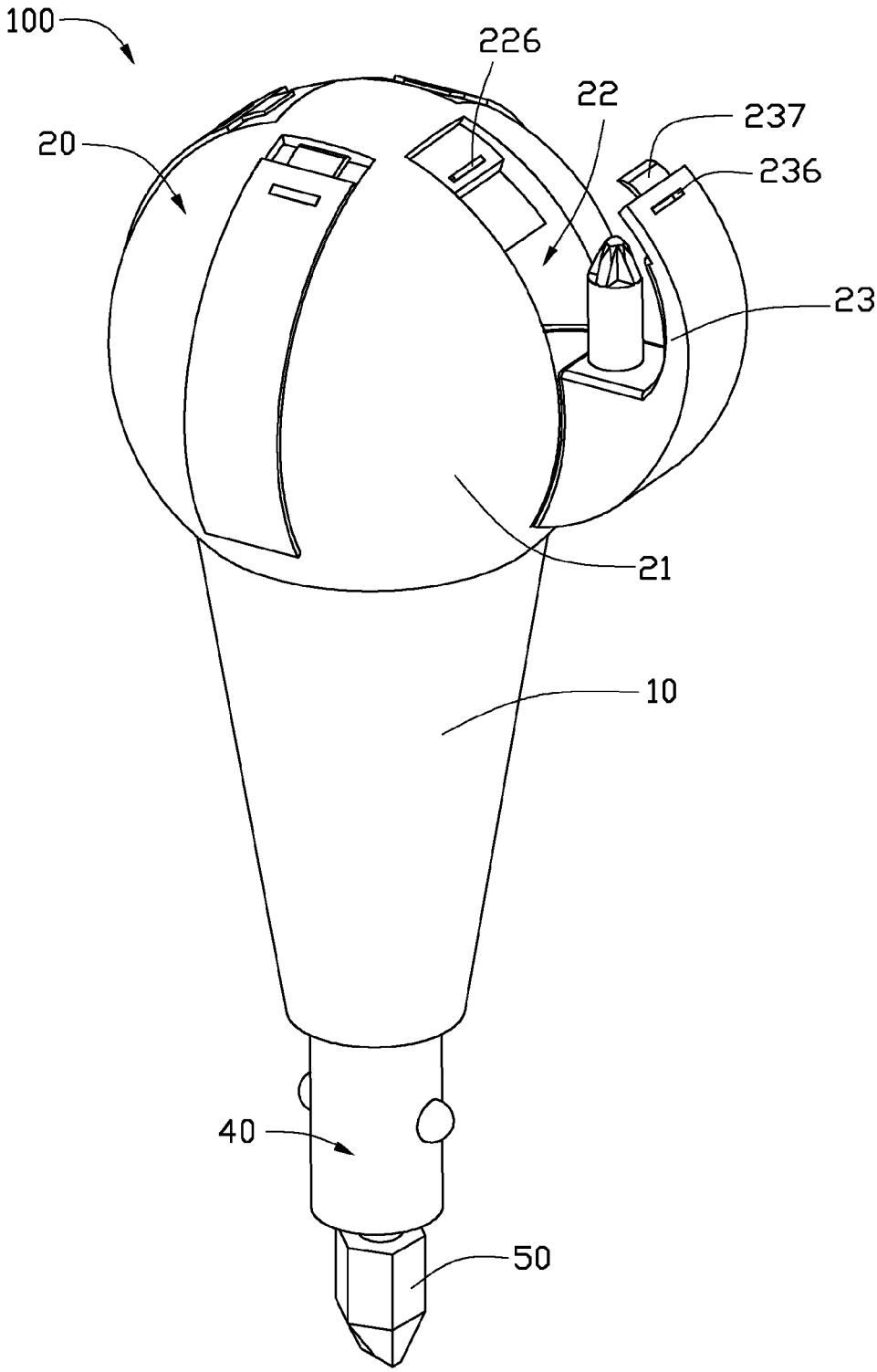
FIG. 2 is a schematic, assembled view of the screwdriver shown in FIG. 1, wherein one head unit of the screwdriver is attached on a pole portion of the screwdriver, and one head lock member of the screwdriver is opened.
Figure 3:
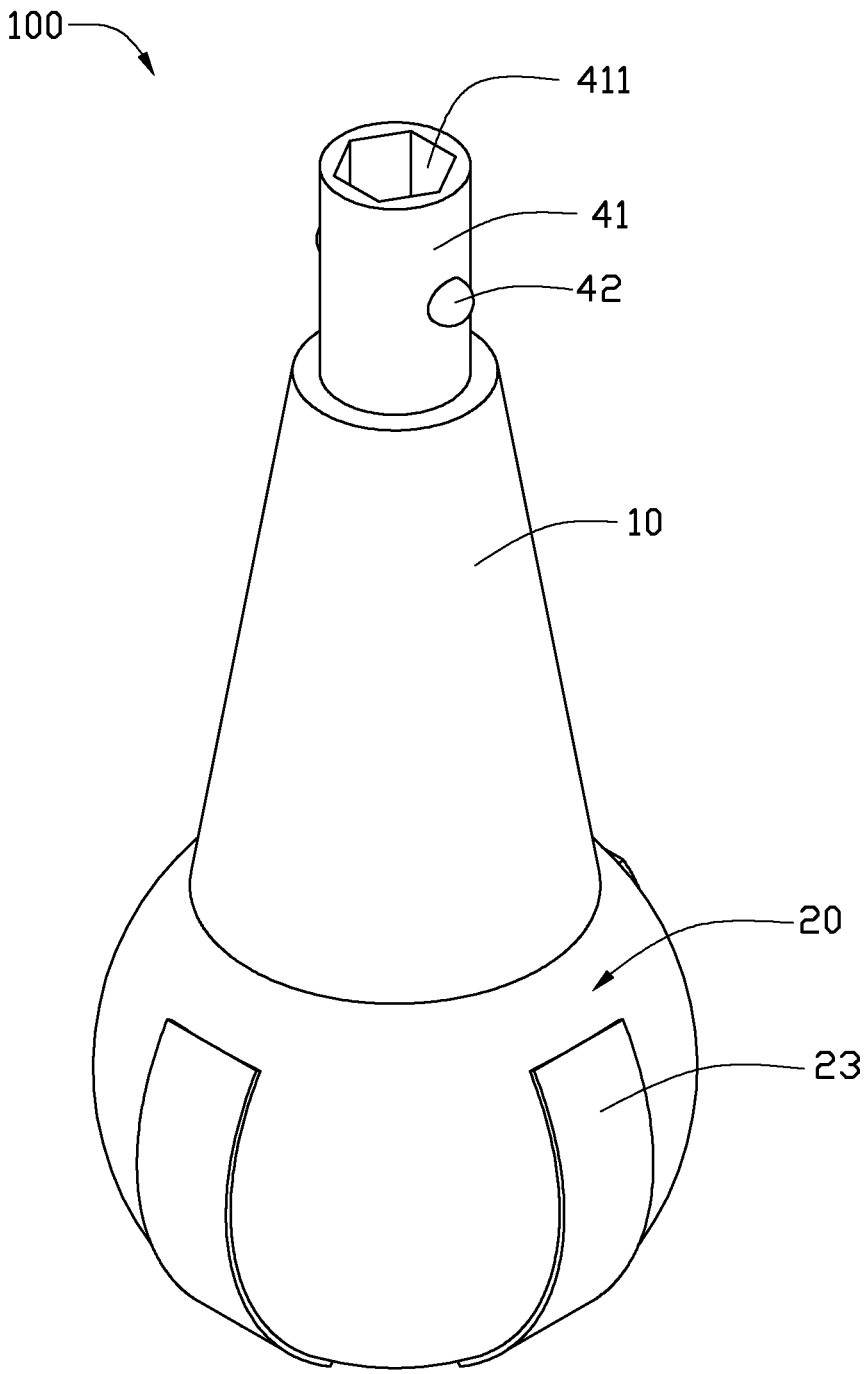
FIG. 3 is similar to FIG. 2, but shown from another angle, and wherein the head unit is detached from the pole portion and the head lock member is closed.

FIGS. 1-3 show a screwdriver 100, according to an exemplary embodiment. The screwdriver 100 includes a handle unit 10, a head reception unit 20, a pole unit 40, and a plurality of head units 50. The handle unit 10 is substantially frusto-conical-shaped and suitable for being manually held together with the head reception unit 20. The head reception unit 20 is substantially spherical. The pole unit 40 is substantially cylindrical. The head reception unit 20, the pole unit 40, and the handle unit 10 cooperatively form one tool. The plurality of head units 50 are configured to operate (i.e., to screw and unscrew) fasteners (e.g., screws and bolts) of different shapes and sizes. Each of the head units 50 can be attached on the pole unit 40 for use, and can be received in the head reception unit 20 when not in use.

In particular, the head reception unit 20 includes a substantially spherical main body 21 and a plurality of head lock members 23. The main body 21 is fixed on the larger end of the handle unit 10 and is coaxial with the handle unit 10. The main body 21 defines a plurality of recessed reception portions 22 for receiving the head lock members 23. In this embodiment, the screwdriver 100 includes four head units 50, and the head reception unit 20 includes four head lock members 23. Each of the head lock members 23 can receive one of the head units 50. The main body 21 defines four equidistantly spaced reception portions 22, and each of the four head lock members 23 is received in a corresponding one of the four reception portions 22.

Each of the reception portions 22 is laid in a direction that is substantially parallel to the longitudinal axis of the handle portion 10, and has two parallel side surfaces 221 and an upper, inner, stepped retaining surface 223 between the side surfaces 221. Each of the side surfaces 221 defines a pivot hole 224 and a sliding groove 225. The pivot hole 224 is defined adjacent to a lower end of the reception portion 22 (that is, opposite to the end of the reception portion 22 having the retaining surface 223). The sliding groove 225 is defined in the middle portion of the side surface 221, and is curved. In particular, the sliding groove 225 begins at a point near an outer extremity of the middle portion of the side surface 221 and continues inwards along the middle portion of the side surface 221, substantially following a line tracing part of a circle centered on the pivot hole 224. A substantially bar-shaped lock protrusion 226 is formed on the retaining surface 223.

Each of the head lock members 23 includes a base portion 231 and an arm portion 232 connected to the base portion 231. The base portion 231 is a substantially fan-shaped block, which includes two planar end surfaces, an arc-shaped end surface, and two substantially fan-shaped and planar side surfaces. The two planar end surfaces are substantially perpendicular to each other. One of the two planar end surfaces is oriented approximately horizontally, and the other planar end surface is oriented approximately vertically. The arc-shaped end surface intersects with both the planar end surfaces. The two side surfaces intersect with both the planar end surfaces and with the arc-shaped end surface. The arm portion 232 is a bent board that includes an arc-shaped outer surface and a curved inner surface. A bottom end of the inner surface of the arm portion 232 is connected to the horizontal planar end surface of the base portion 231. A bottom end of the outer surface of the arm portion 232 is connected to the arc-shaped end surface of the base portion 231, and the arc shape of the outer surface of the arm portion 232 is a smooth, seamless continuation of the arc-shaped end surface of the base portion 231.

The width of the base portion 231 (i.e., the distance between the two side surfaces) and the width of the arm portion 232 are substantially equal to each other. That is, the head lock member 23 has a uniform width, which is substantially equal to a corresponding width of the respective reception portion 22, such that the head lock member 23 can be inserted into the reception portion 22 and rotated out from the reception portion 22. A reception groove 233 is defined in the horizontal planar end surface of the base portion 231.

Each of the head lock members 23 further includes a pair of rotation protrusions 234 corresponding to the pivot holes 224, a pair of sliding protrusions 235 corresponding to the sliding grooves 225, a retaining groove 236 corresponding to the lock protrusion 226, and an operation portion 237. In particular, each of the side surfaces of the base portion 231 has one of the rotation protrusions 234 and one of the sliding protrusions 235 formed thereon. The rotation protrusion 234 is formed adjacent to the intersection of the arc-shaped end surface and the vertical planar end surface of the base portion 231. The sliding protrusion 235 is formed adjacent to the intersection of the two planar end surfaces. The retaining groove 236 is defined in the arm portion 232, and is positioned adjacent to the distal end of the arm portion 232. In this embodiment, the operation portion 237 is a bar-shaped protrusion extending from the distal end of the arm portion 232. A horizontal width of the operation portion 237 is less than the width of the arm portion 232.

Referring particularly to FIG. 3, the pole unit 40 includes a substantially cylindrical pole body 41 and a pair of latch components 42. The pole body 41 is connected to the smaller end of the handle unit 10 and is coaxial with the handle unit 10. A polygonal assembling hole 411 for receiving and gripping any selected one of the head units 50 is defined in the pole body 41. The latch components 42 can be common resilient latch apparatuses. When attached in the assembling hole 411, the selected head unit 50 can be locked in position by spring pressure, and can be released by pressing the latch components 42 toward each other. Furthermore, the latch components 42 can instead be any other kind of common latch apparatuses, such as magnetic latch apparatuses.

Each of the head units 50 has a polygonal head base 51 corresponding to the assembling hole 411 and a head tip 52 connected to the head base 51. The head tips 52 are contoured with different shapes and sizes, and each may be used to screw and unscrew a different kind of fastener (e.g., a screw or a bolt).

In assembly, the head base 51 of each of the head units 50 is received in the reception groove 233 of a corresponding one of the head lock members 23. The pair of rotation protrusions 234 of the head lock member 23 of each head unit 50 are rotatably received in the two pivot holes 224 of a corresponding one of the reception portions 22, respectively. The pair of sliding protrusions 235 of the head lock member 23 are slidably received in the two sliding grooves 225 of the corresponding reception portion 22, respectively. In this way, the head lock members 23 with the head units 50 received therein are rotatably attached to the main body 21, and can be rotated inward to retracted (closed) positions inside the main body 21.

When the screwdriver 100 is not in use, the head lock members 23 are pushed towards the center of the main body 21 to be in the closed positions. The lock protrusion 226 of each of the reception portions 22 engages in the retaining groove 236 of the corresponding head lock member 23 to retain the head lock member 23 in the closed position. The outer surface of the arm portion 232 and the arc-shaped end surface of the base portion 231 of each of the head lock members 23 are substantially flush with the outer surface of the main body 21 to form a substantially spherical outer surface of the head reception unit 20. In this way, the head reception unit 20 is substantially smooth and round, which helps protects the head reception unit 20 from impact and scratching.

When one of the head units 50 is selected for use, the operation portion 237 of the head lock member 23 that holds the selected head unit 50 is operated by a user to open the head lock member 23, and the selected head unit 50 is taken out of the reception groove 233 of the head lock member 23. The head lock member 23 is then closed. The head base 51 of the selected head unit 50 is inserted into the assembling hole 411, and secured by the latch components 42. Thus, the screwdriver 100 is ready to screw and unscrew a fastener (e.g., a screw) of a type corresponding to the selected head unit 50. When another of the head units 50 needs to be used, the latch components 42 are operated to release the installed head unit 50, and the other head unit 50 is fixed on the pole unit 40 according to the aforementioned method. The previously installed head unit 50 is replaced in the reception groove 233 of its corresponding head lock member 23, and the corresponding head lock member 23 is closed. This provides safekeeping for the previously installed head unit 50, and facilitates use of the screwdriver 100.

In summary, the screwdriver 100 has a plurality of changeable head units 50 received therein, and can be used to screw and unscrew fasteners (e.g., screws and bolts) of different shapes and sizes. Furthermore, the head reception unit 20 functions as an efficient, safe and portable storage for the head units 50.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A screwdriver, comprising:

a handle unit;

a plurality of head units for operating different kinds of fasteners;

a head reception unit fixed on one end of the handle unit, the plurality of head units removably receivable in the head reception unit; and a pole unit fixed on an opposite end of the handle unit;

wherein each of the head units is removably attachable on the pole unit so that the screwdriver can operate the different kinds of fasteners as required; and wherein each of the head units includes a polygonal head base and a head tip connected to the head base, the head tips of the head units having different shapes and sizes corresponding to the different kinds of screws; the pole unit defines a polygonal assembling hole corresponding to the head bases of the head units; and the head bases of the head units are removeably attachable in the assembling hole, the head reception unit includes a substantially spherical main body and a plurality of head lock members rotatably mounted on the main body, and one or more of the head units that are not attached on the pole unit are respectively received in the head lock members, the main body defines a plurality of recessed reception portions, and the head lock members are rotatably received in the reception portions, respectively, each of the reception portions has two side surfaces, each of the side surfaces defining a pivot hole and a sliding groove; and each of the head unit lock members further includes a pair of rotation protrusions and a pair of sliding protrusions, the rotation protrusions respectively rotatably received in the two pivot holes of a corresponding one of the reception portions and the sliding protrusions respectively slidably received in the two sliding grooves of the corresponding reception portion, such that the head lock member is rotatably received in the corresponding reception portion, each of the head lock members includes a base portion, which is a substantially fan-shaped block and includes two planar end surfaces, an arc-shaped end surface, and two substantially fan-shaped and planar side surfaces; the two planar end surfaces are substantially perpendicular to each other, the arc-shaped end surface intersects with one of the planar end surfaces, and the two side surfaces intersect with both the planar end surfaces and the arc-shaped end surface; and each of the side surfaces has one of the pair of rotation protrusions and one of the pair of the sliding protrusions formed thereon, each of the head lock members defines a reception groove in the other one of the planar end surfaces of the base portion, and the head bases of the head units that are not attached on the pole unit are respectively received in the reception grooves, each of the head lock members further includes an arm portion, which is a bent board connected to an end of the planar side surface defining the reception groove; and wherein each of the head lock members further defines a retaining groove in the arm portion, a lock protrusion is formed in each of the reception portions, and the lock protrusions are respectively received in the retaining grooves to retain the head lock members in closed positions substantially inside the main body.

2. The screwdriver of claim 1, wherein each of the head lock members further includes an operation portion for facilitating opening and closing the head lock member, the operation portion extends from a distal end of the arm portion of the head lock member.

* * * * *